US007458355B2

(12) United States Patent
Fujita et al.

(10) Patent No.: US 7,458,355 B2
(45) Date of Patent: Dec. 2, 2008

(54) RECOIL STARTER

(75) Inventors: Hirotoshi Fujita, Tokyo (JP); Isao Tohyama, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 11/854,146

(22) Filed: Sep. 12, 2007

(65) Prior Publication Data

US 2008/0072864 A1 Mar. 27, 2008

(30) Foreign Application Priority Data

Sep. 22, 2006 (JP) ..... P2006-257346

(51) Int. Cl.
*F02N 3/02* (2006.01)

(52) U.S. Cl. ..... 123/185.3

(58) Field of Classification Search ..... 123/185.14, 123/185.2–185.4

See application file for complete search history.

(56) References Cited

U.S. PATENT DOCUMENTS

| | | | | |
|---|---|---|---|---|
| 3,306,277 | A | 2/1967 | Gudmundsen | |
| 6,325,036 | B1 * | 12/2001 | Gracyalny et al. | 123/185.14 |
| 6,588,390 | B2 * | 7/2003 | Kawasaki et al. | 123/185.3 |
| 6,718,931 | B2 | 4/2004 | Morishige et al. | |
| 6,755,170 | B2 * | 6/2004 | Morishige et al. | 123/185.3 |
| 6,971,359 | B2 * | 12/2005 | Tohyama | 123/185.3 |
| 6,981,482 | B2 * | 1/2006 | Tsunoda et al. | 123/185.3 |
| 7,028,658 | B2 * | 4/2006 | Kruse et al. | 123/185.3 |
| 7,069,896 | B2 * | 7/2006 | Tsunoda et al. | 123/185.3 |
| 7,093,577 | B2 * | 8/2006 | Tohyama | 123/185.3 |
| 7,174,874 | B2 | 2/2007 | Horikoshi | |
| 2002/0121257 | A1 * | 9/2002 | Morishige et al. | 123/185.3 |
| 2002/0174848 | A1 * | 11/2002 | Nieda et al. | 123/185.14 |
| 2003/0015162 | A1 | 1/2003 | Harada et al. | |
| 2003/0037750 | A1 * | 2/2003 | Ueda et al. | 123/185.14 |

FOREIGN PATENT DOCUMENTS

| | | |
|---|---|---|
| EP | 1 203 883 | 5/2002 |
| EP | 1 253 315 | 10/2002 |
| EP | 1 384 881 | 1/2004 |
| JP | 2002-138929 | 5/2002 |
| JP | 2006-132519 | 5/2006 |

* cited by examiner

*Primary Examiner*—Stephen K Cronin
*Assistant Examiner*—Arnold Castro
(74) *Attorney, Agent, or Firm*—Nixon & Vanderhye P.C.

(57) ABSTRACT

A recoil starter includes: a rope reel on which a recoil rope, one end of which is held on an outside of a starter case, is wound and which is fitted turnably on a reel pivot formed on an inside of the starter case; a recoil spring that turns and energizes the rope reel in a direction along which the recoil rope is rewound; a cam member one end of which is fitted turnably onto the reel pivot to oppose to the rope reel and which transfers a turning to an engine side via a ratchet mechanism; and a coil spring-like damper spring both ends of which are engaged with the rope reel and the cam member respectively; a bearing portion that supports turnably the cam member; and a dust cover provided integrally with the starter case.

4 Claims, 2 Drawing Sheets

RECOIL STARTER

BACKGROUND OF THE INVENTION

1. Field of the Invention

The present invention relates to a recoil starter for starting an engine by pulling out one end, which is held on the outside of a starter case, of a recoil rope wound on a rope reel so as to turn the rope reel, then transferring a turning of the rope reel to a cam member via a damper spring, and then transferring a turning of the cam member to the engine side via a ratchet mechanism.

2. Background Art

An existing recoil starter is disclosed in JP-A-2006-132519. The recoil starter is constructed to start the engine by interposing the damper spring wound like a coil spring between the rope reel and the cam member. Both members are coupled elastically via the damper spring in the turning direction such that, when the recoil rope is pulled out, the turning of the rope reel is transferred to the cam member via the damper spring and then the turning of this cam member is transferred to the engine side via the ratchet mechanism.

SUMMARY OF THE INVENTION

In the above recoil starter in the prior art, the rope reel, the recoil spring, the damper spring, etc. as constituent members of main mechanism portions are housed and arranged in the starter case. The opening portion of the starter case constitutes the structural portion with which the cam member and the ratchet mechanism of the turning member engage. Therefore, such opening portion is partially covered with these members, but this opening portion is not positively covered with any member. As a result, dust enters into the starter case through the opening portion of the starter case.

Dust that enter into the starter case adhere to the constituent members of the main mechanism portions such as the rope reel, the recoil spring, the damper spring, etc., and cause such drawbacks that returning of the rope being pulled out from the rope reel by a pulling operation is worsened, and the like.

However, no particular dustproof measure has been adopted to positively prevent such drawbacks.

In order to solve the above problems in the prior art, the present invention proposes an improved structure of the recoil starter. It is an object of the present invention to provide a recoil starter whose dustproof property is excellent and whose operation is stable, capable of positively preventing the drawbacks of a defective operation caused due to adhesion of dust onto constituent members of main mechanism portions housed and arranged in a starter case, i.e., a recoil spring, a rope reel, a damper spring, etc. by preventing the adhesion of dust to these members.

In order to solve the above problems, according to a first aspect of the invention, there is provided a recoil starter including: a rope reel on which a recoil rope, one end of which is held on an outside of a starter case, is wound and which is fitted turnably on a reel pivot formed on an inside of the starter case; a recoil spring that turns and energizes the rope reel in a direction along which the recoil rope is rewound; a cam member one end of which is fitted turnably onto the reel pivot to oppose to the rope reel and which transfers a turning to an engine side via a ratchet mechanism; and a damper spring both ends of which are engaged with the rope reel and the cam member respectively, whereby an engine is started by transferring a turning force of the rope reel to the cam member via an elasticity of the damper spring; a bearing portion that turnably supports the cam member; and a dust cover provided integrally with the starter case to define a sealed space in which the rope reel, a recoil spring, at least a portion of the cam member and the damper spring are housed.

According to a second aspect of the invention, in the recoil starter according to the first aspect of the invention, the cam member includes: a cam base on which the damper spring is fitted; and a cam plate including cam claws that engage with the ratchet mechanism.

According to a third aspect of the invention, there is provided the recoil starter according to the first or the second aspect of the invention, wherein a dust seal is fitted to a bearing portion of the dust cover.

According to a fourth aspect of the invention, there is provided the recoil starter according to any one of the first to the third aspect of the invention, wherein engaging portions at both ends of the damper spring are bent like a U-shape respectively.

According to the first aspect of the invention, the bearing portion constructed integrally with the starter case to support turnably the other end of the cam member when the bearing portion is fixed to the starter case is provided, and also the dust cover constituting the sealed space in which the main mechanism portions are housed so as to project only the cam claws that engage with the ratchet mechanism of the cam member to the outside is provided. Therefore, members of the main mechanism portions such as the rope reel, the recoil spring, the damper spring, the portion of the cam member to which the damper spring is fitted, etc. are housed and arranged in the sealed space that is covered with the dust cover being integrated with the starter case. As a result, generation of the drawbacks such as the wrong return of the recoil rope, which has been extracted by the pulling operation of the rope reel, due to the adhesion of dust onto the recoil spring and the recoil rope, for example, and the like can be avoided. Also, since the bearing portion of the dust cover bears/supports the other end of the cam member, stable turning/supporting of the cam member can be attained and also provision of another member for supporting the cam member is not needed. Thus, a simplification of configuration can be achieved.

According to the second aspect of the invention, the cam member is constructed by the cam base on which the damper spring is fitted, and by the cam plate having cam claws that engage with the ratchet mechanism. Therefore, the cam base used in fitting the damper spring of the cam member is housed in the space covered with the dust cover, nevertheless the cam plate with the cam claws of the cam member can be exposed from the space covered with the dust cover. As a result, an engaging operation between the cam claws of the cam member and the ratchet mechanism can be carried out without hindrance. Also, the bearing/supporting of the cam member consisting of the cam base and the cam plate by using the dust cover can be facilitated.

According to the third aspect of the invention, the dust seal is fitted to the bearing portion, which supports turnably the cam member, of the dust cover. As a result, a dustproof effect of the bearing portion can be improved.

According to the fourth aspect of the invention, the engaging portions at both ends of the damper spring are bent like a U-shape respectively. As a result, the engagement of both ends of the damper spring with the rope reel and the cam member can be facilitated, and also a reduction in fitting cost of the damper spring can be attained.

BRIEF DESCRIPTION OF THE DRAWINGS

These and other objects and advantages of this invention will become more fully apparent from the following detailed description taken with the accompanying drawings in which.

DETAILED DESCRIPTION OF THE EMBODIMENTS

Figure 1:
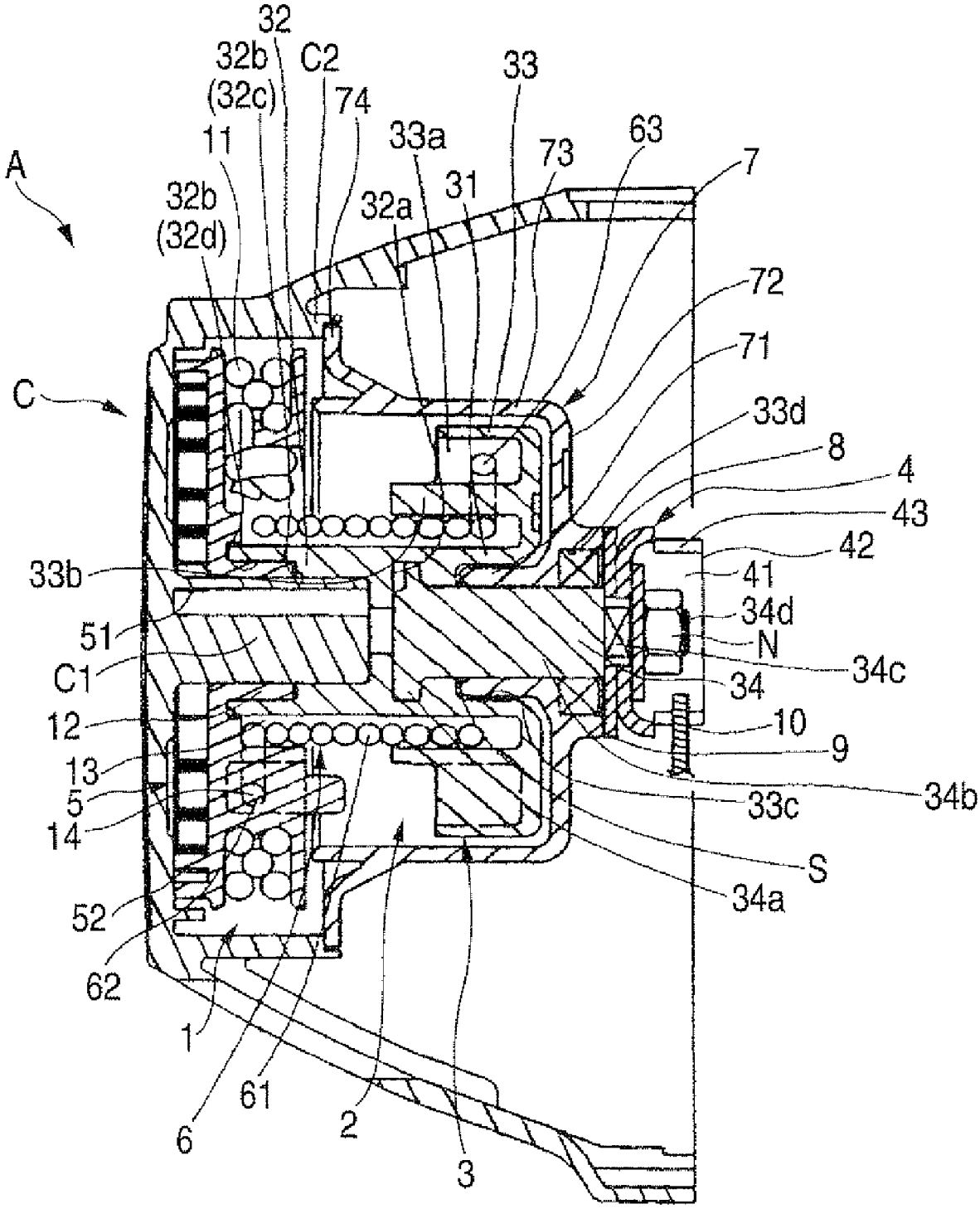
FIG. 1 is a longitudinal sectional view of a recoil starter according to an embodiment of the present invention.

A characteristic feature of the present invention is that, in a recoil starter A for starting an engine by transferring a turning force of a rope reel 1 to a cam member 2 via an elasticity of a damper spring 6, and then transferring the turning of the cam member 2 to the engine side via a ratchet mechanism 10, constituent members of main mechanism portions except structural portions being inevitably exposed, such as cam claws 43 of the recoil starter A, etc. are housed in a sealed space covered with a dust cover 7 that is formed integrally with a starter case C in such a way that no dust adheres to the constituent members of the main mechanism portions such as a recoil spring 5, the rope reel 1, the damper spring 6, and the like.

Then, a more concrete embodiment will be explained hereinafter.

The recoil starter A of the present invention is shown in FIG. 1. First, an outline of the recoil starter will be described hereunder. The rope reel 1 is arranged turnably in the starter case C, and a recoil rope 11 whose one end is held on the outside of the starter case C is wound on the rope reel 1. This rope reel 1 is turned/driven when a handle (not shown) connected to an end portion of the recoil rope 11 is pulled out. Then, the cam member 2 that is arranged turnably coaxially with the rope reel 1 is turned following upon the turning of the rope reel 1. Thus, the ratchet mechanism 10 formed on a turning member fitted to the engine side engages the cam claws 43 formed on a cam plate 4 of the cam member 2. Then, a crankshaft (not shown) fitted to the turning member is turned to start the engine.

As mentioned above, the recoil starter A is constructed roughly. More concretely, the rope reel 1 on the outer periphery of which the recoil rope 11 is wound is supported turnably by a reel pivot C1 via a bearing boss portion 12 positioned in a center portion of the starter case. This reel pivot C1 is formed integrally with the starter case C to project inward from the starter case C. Then, the recoil rope 11 is wound on the outer periphery of the rope reel 1 such that one end of the recoil rope 11 is held on the outside of the starter case C and the other end side is fixed to the rope reel 1.

The handle is connected to one end side, which is held on the outside of the starter case C, of the recoil rope 11 (not shown). When this handle is pulled, the recoil rope 11 wound on the outer periphery of the rope reel 1 is pulled out from the rope reel 1. Thus, the rope reel 1 is turned/driven around the reel pivot C1.

The recoil spring 5 is arranged between a left side surface of the rope reel 1 and an inner wall surface of the starter case C. This recoil spring 5 rewinds the unwound recoil rope 11 into the rope reel 1 by turning the rope reel 1, which has been turned by pulling out the recoil rope 11, in the opposite direction. One end 51 of the recoil spring 5 on the inner peripheral side is fixed to the starter case C, and the other end 52 on the outer peripheral side is fixed to the rope reel 1. This recoil spring 5 acts in such a way that a turning force is accumulated in the recoil spring 5 while the rope reel 1 is turned by pulling out the recoil rope 11 and then this turning force accumulated in the recoil spring 5 causes the rope reel 1 to turn in the opposite direction and rewind the recoil rope 11 on the rope reel 1 when a pulling force of the recoil rope 11 is released.

The cam member 2 transfers the turning of the rope reel 1 to the turning member fitted to the crankshaft side of the engine (not shown). This cam member 2 is fitted turnably to the reel pivot C1 formed in the starter case C and is supported by a bearing portion 71 of the dust cover 7, which is formed integrally with the starter case C described later, to be pressed from the outer side. Thus, the cam member 2 is prevented from coming off. Upon holding the cam member 2, the rope reel 1 is also held via the cam member 2 not to come off the reel pivot C1.

As can be understood with reference to FIG. 1, the cam member 2 is constructed by a cam base 3 and the cam plate 4. The cam base 3 is formed of the synthetic resin material, or the like. This cam base 3 has a base portion 31, a boss portion 32 projected from the base portion 31 toward the rope reel 1, an annular flange portion 33 protruded outward from the base portion 31 in the radial direction, and a bolt member 34. When an enlarged head portion 34*a* of this bolt member 34 is embedded/fixed in/to an inner circular groove portion 32*a* near a base portion of the boss portion 32, this bolt member 34 is assembled together with the cam base 3 to project its top end portion from the cam base 3 to the engine side.

Also, a fitted concave portion 32*b* whose inner diameter is shaped into a two-stepped diameter is formed on the top end side of the boss portion 32 of the cam base 3. One end of the cam base 3 on the left side (the rope reel 1 side) is supported by the reel pivot C1 and the rope reel 1. More particularly, a smaller-diameter inner diameter portion 32*c* of the fitted concave portion 32*b* of the boss portion 32, whose inner diameter is shaped into a two-stepped diameter, is fitted turnably into the reel pivot C1 being formed integrally with the starter case C, and a larger-diameter inner diameter portion 32*d* is fitted turnably on an outer periphery of the bearing boss portion 12 of the rope reel 1.

In contrast, the other end of the cam base 3 on the right side (the engine side) is supported turnably by the bearing portion 71 of the dust cover 7, described later, via the bolt member 34. More particularly, a recess portion 33*c* opened toward the engine side is on the base portion 31 of the cam base 3, and a larger-diameter shaft portion 34*b* of the bolt member 34 pass through a center portion of the recess portion 33*c* to leave a clearance around it, whereby the recess portion 33*c* forms an annular space S around the bolt member 34. When the boss portion of the bearing portion 71 of the dust cover 7 fixed to the starter case C is fitted into this annular space S, the cam base 3 is supported turnably by the boss portion via the bolt member 34 and also its movement in the axial direction is prevented. The prevention of the movement the cam base 3 in the axial direction leads to the boss portion 32 from coming off of the cam base 3 from the reel pivot C1 in the turning supporting portion on the left side, which is already described.

The annular flange portion 33 projecting from the base portion 31 of the cam base 3 outward in the radial direction has an annular concave portion 33*a* on the opposing surface side to the rope reel 1. A spring engaging portion 33*b* used to fit the end portion of the damper spring 6 is provided to this annular concave portion 33*a*. The end portion of the damper spring 6 fitted between opposing surfaces of the rope reel 1 and the annular flange portion 33 is secured to the spring engaging portion 33*b*, as described later.

The damper spring 6 has a cylindrically wound portion 61 whose length is substantially identical to a length of the boss portion 32 of the cam base 3. In a free state, this damper spring 6 is wound cylindrically to leave a predetermined clearance between the outer peripheral surface of the boss portion 32 and the inner surface of the cylindrically wound portion 61 such that all portions in the length direction are held on the outer peripheral surface of the boss portion 32.

Figure 3:
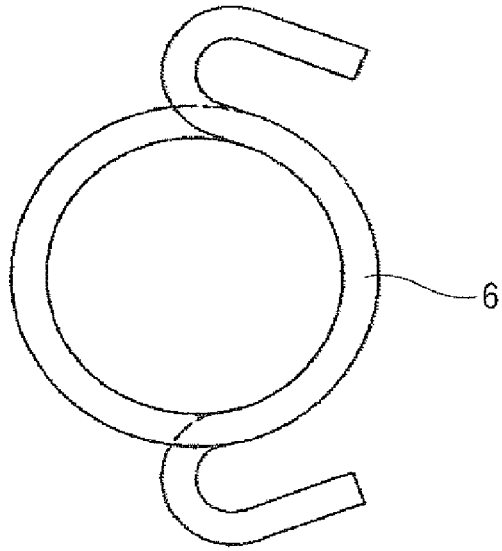
FIG. 3 is an end surface view of a damper spring.

Also, as shown in FIG. 3, both end portions of the damper spring 6 are bent like a U-shape. One U-shaped end 62 is inserted into an engaging hole 14, and engaged to this engaging hole 14 such that this bent end portion can be moved in the radial direction. This engaging hole 14 is formed as a cut hole in the circumferential direction in a wall portion of an annular concave portion 13 on the outer peripheral side than the bearing boss portion 12 as the opposing surface of the rope reel 1. Also, the other U-shaped end 63 is inserted into the spring engaging portion 33*b* of the annular concave portion 33*a* of the annular flange portion 33 as the opposing surface of the cam base 3 along the circumferential direction, and is engaged to this spring engaging portion 33*b* such that this bent end portion can be moved in the radial direction. That is, a thickness of the spring engaging portion 33*b* in the radial direction is formed smaller than a width between the inner sides of the U-shaped bent portions. The damper spring 6 is fitted between the mutual opposing surfaces of the cam base 3 and the rope reel 1 such that the turning force of the rope reel 1 is transferred to the cam base 3, i.e., the cam member 2 via the damper spring 6.

In other words, the rope reel 1 and the cam member 2 are coupled together via the damper spring 6 in the turning direction such that the turning of the rope reel 1, when turned by pulling the recoil rope 11, is transferred to the cam member 2 side via an elasticity of the damper spring 6. An outer dimension of the boss portion 32 formed on the cam base 3 of the cam member 2 is formed smaller than a dimension of the damper spring 6 in a free state. As a result, normally the damper spring 6 is supported to have a clearance from the outer peripheral surface of the boss portion 32, and is separated from the boss portion 32.

However, when the turning of the cam member 2 side is stopped by the starting resistance of the engine while the rope reel 1 is turned in the direction to start the engine, a diameter of the cylindrically wound portion 61 of the damper spring 6 is reduced due to a twist of the damper spring 6. Thus, the damper spring 6 is wound tightly on the outer peripheral surface of the boss portion 32 formed on the cam base 3 of the cam member 2, and a further elastic deformation of the damper spring 6 can be prevented.

The projected portion of the bolt member 34 projected in the opposite direction to the boss portion 32 of the cam base 3 has the larger-diameter shaft portion 34*b* extended from the enlarged head portion 34*a* embedded/secured in/to the inside of the boss portion 32, a smaller-diameter shaft portion 34*c* shaped into a square shaft adjacent to the larger-diameter shaft portion 34*b*, and a threaded portion 34*d* extended from the smaller-diameter shaft portion 34*c*. The larger-diameter shaft portion 34*b* is fitted/supported turnably in/by the bearing portion 71 of the dust cover 7, already described, to pass through the bearing portion 71. A dust seal 8 is fitted between the outer periphery of the larger-diameter shaft portion 34*b* and an annular concave portion 33*d* of the dust cover 7 adjacent to the bearing portion. This dust seal 8 is pressed from the outside by a presser plate 9 fitted onto the smaller-diameter shaft portion 34*c* as a square shaft. Then, the cam plate 4 is fitted on the outside of the presser plate 9 not to turn relatively to the smaller-diameter shaft portion 34*c*, and is fixed by screwing a nut N via a washer.

The dust cover 7 is shaped into an almost bowl shape. This dust cover 7 is constructed to have a boss portion as the bearing portion 71 constituting a center bottom portion of the bowl shape, i.e., a boss portion having the bearing portion 71 by which the larger-diameter shaft portion 34*b* of the bolt member 34 is supported in a turnable fashion, a portion 72 for covering an outer side portion of the annular flange portion 33 of the cam base 3, which constitutes a bottom portion of the bowl shape extended outward from the boss portion, on the opposite side to the rope reel 1, and an annular peripheral portion 73 extended toward the rope reel 1 side, for covering the outer peripheral portion of the cam base 3 constituting an annular peripheral portion of the bowl shape. This dust cover 7 is fixed integrally with the starter case C because an annular end portion 74 of the annular peripheral portion 73 is joined to an annular extended end C2 that covers the outer periphery of the rope reel 1 in the starter case C.

Then, because the dust cover 7 is fixed integrally with the starter case C, this dust cover 7 and the starter case C constitute the sealed space in which the constituent members of the main mechanism portions such as the rope reel 1, the cam base 3, the damper spring 6, the recoil spring 5, etc. are housed and arranged.

Figure 2:
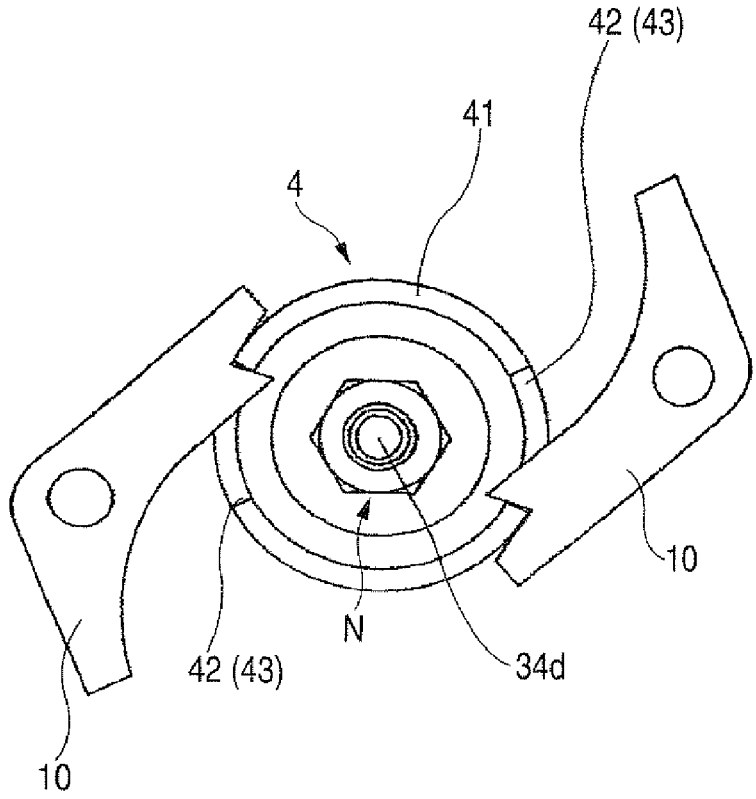
FIG. 2 is a view showing an engagement/disengagement relationship between cam claws of a cam member and a ratchet mechanism.

The cam plate 4 of the cam member 2 is also shaped into an almost bowl shape. As can be understood by referring to FIG. 1 together with FIG. 2, an annular end portion of a cylindrically extended portion 1 constituting the annular peripheral portion of the bowl shape is cut off in a symmetrical position on a line passing through a center portion of the annular portion. Two cut-off concave portions 42 constitute the cam claws 43 that have a symmetrical shape respectively to put the center portion between them. The cam claws 43 are formed such that they are engaged/disengaged with/from the ratchet mechanism 10 formed on the turning member on the engine (not shown) side. Because the cam claws 43 engage with the ratchet mechanism 10 of the turning member, the turning of the cam member 2 is transferred to the turning member to turn the crankshaft of the engine (not shown) via this turning member.

The ratchet mechanism 10 is constructed as a centrifugal clutch. Thus, after the engine is started, the turning member is turned by the engine and then the ratchet mechanism 10 is operated by a centrifugal force in the direction to disengage from the cam claws 43. Accordingly, the transmission of the turning force between the engine side and the cam member 2 is cut off not to transfer the turning of the engine side to the recoil starter A side.

The recoil starter A of the embodiment of the present invention executes following operations because it has the above configuration.

Before the engine is started/operated, the ratchet mechanism 10 formed on the turning member being coupled with the crankshaft of the engine (not shown) is arranged in a position where it engages with the cam claws 43 formed on the cam plate 4 of the cam member 2, because of an action of a ratchet spring (not shown). When the recoil rope 11 is pulled out, the rope reel 1 is turned to cause the cam member 2 to turn together via the damper spring 6.

The cam claws 43 of the cam member 2 come in touch with the ratchet mechanism 10 to cause the turning member (not shown) to turn via the ratchet mechanism 10 and then cause the crankshaft of the engine to be coupled to the turning member. At this time, when a turning load of the turning member is increased because of the starting resistance of the engine and thus the turning of the cam member 2 is stopped, the damper spring 6 is twisted to absorb this load and also a turning force on the rope reel 1 side is accumulated in the damper spring 6.

In case the starting load on the engine side is extremely heavy, the damper spring 6 is largely twisted and the outer diameter of the cylindrically wound portion 61 of the damper spring 6 is reduced. Thus, the damper spring 6 is tightly wound on the outer peripheral surface of the boss portion of the cam base 3 of the cam member 2, and no stress acts to the damper spring 6 beyond that. In this condition, the rope reel 1 and the cam member 2 are coupled mutually by the damper spring 6 because of an action of the spring clutch, so that the turning of the rope reel 1 is transferred directly to the cam member 2.

In this manner, the damper spring 6 is wound tightly over its full length on the outer peripheral surface of the boss portion 32 that is formed on the cam base 3 of the cam member 2. Therefore, an excessive deformation is not generated in the damper spring 6, such that the damper spring 6 is prevented from being damaged or prevented from decreasing its durability. At this time, the engaging portions 62, 63 at both ends of the damper spring 6 are moved toward the inner diameter direction respectively. Therefore, the cylindrically wound portion 61 of the damper spring 6 is brought into tight contact with the outer peripheral surface of the boss portion 32 over an almost full length, and thus no excessive stress is generated at both base portions of the damper spring 6.

Also, when a turning force of the rope reel 1 exceeds the starting load of the engine while the rope reel 1 is turned, a turning force of the rope reel 1 generated by pulling out the recoil rope 11 and a turning force accumulated in the damper spring 6 are emitted to the cam member 2 side and are transferred to the turning member (not shown) via the ratchet mechanism 10. Therefore, the crankshaft of the engine is turned and the engine is started.

As soon as the crankshaft is turned after the engine is started, the ratchet mechanism 10 is turned outward by an action of a centrifugal force. Then, the ratchet mechanism 10 is disengaged from the cam claws 43 of the cam member 2. Thus, the turning of the engine is not transferred to the cam member 2 side. When the recoil rope 11 is loosened after the engine is started, the rope reel 1 is turned in the opposite direction by a turning force accumulated in the recoil spring 5 to unwind the recoil rope 11 on the rope reel 1.

Also, in the embodiment of the present invention that has the above configuration and can achieve the above advantages, the constituent members of the main mechanism portions except the cam claws 43 being engaged/disengaged with/from the ratchet mechanism 10 are positioned/arranged in the sealed space that is covered with the dust cover 7 formed integrally with the starter case C. Therefore, the constituent members of the main mechanism portions such as the rope reel 1, the recoil spring 5, the damper spring 6, etc. are protected against the adhesion of dust and thus no defective operation is caused. As a result, such excellent advantages can be achieved that the drawbacks such as the wrong return of the recoil rope 11 being pulled out to turn the rope reel 1 can be solved, for example, and the like.

Therefore, the recoil starter A having excellent dustproof properties and is stable in operation can be obtained.

What is claimed is:

1. A recoil starter comprising:

a rope reel on which a recoil rope, one end of which is held on an outside of a starter case, is wound and which is fitted turnably on a reel pivot formed on an inside of the starter case;

a recoil spring that turns and energizes the rope reel in a direction along which the recoil rope is rewound;

a cam member one end of which is fitted turnably onto the reel pivot to oppose to the rope reel and which transfers a turning moment to an engine side via a ratchet mechanism;

a damper spring having two ends engaged with the rope reel and the cam member respectively, whereby an engine is started by transferring a turning force of the rope reel to the cam member via an elasticity of the damper spring;

a bearing portion that turnably supports the cam member; and a dust cover provided integrally with the starter case to define a sealed space in which the rope reel, a recoil spring, at least a portion of the cam member and the damper spring are housed.

2. The recoil starter according to claim 1, wherein the cam member includes:

a cam base on which the damper spring is fitted; and a cam plate including cam claws that engage with the ratchet mechanism.

3. The recoil starter according to claim 1, wherein a dust seal is fitted to a bearing portion of the dust cover.

4. The recoil starter according to claim 1, wherein engaging portions at both ends of the coil spring-like damper spring are bent a U-shape respectively.

* * * * *